United States Patent [19]

Deike

[11] 4,124,081

[45] Nov. 7, 1978

[54] POST DRIVING MACHINE

[75] Inventor: Robert F. Deike, Cheyenne, Wyo.

[73] Assignee: Foresight Industries, Cheyenne, Wyo.

[21] Appl. No.: 674,901

[22] Filed: Apr. 8, 1976

Related U.S. Application Data

[63] Continuation-in-part of Ser. No. 575,462, May 7, 1975, Pat. No. 4,050,526.

[51] Int. Cl.[2] ..... E04H 17/26

[52] U.S. Cl. ..... 173/28; 173/20; 173/43; 173/119; 173/139; 173/147

[58] Field of Search ..... 173/22, 28, 15, 16, 173/43, 119, 147

[56] References Cited

U.S. PATENT DOCUMENTS

| | | | |
|---|---|---|---|
| 2,627,846 | 2/1953 | Boedecker | 173/119 |
| 2,881,739 | 4/1959 | Huppert | 173/134 |
| 2,903,949 | 9/1959 | Simmonds | 173/28 |
| 3,165,332 | 1/1965 | Barker, Jr. et al. | 267/25 |
| 3,240,279 | 3/1966 | Dorkins | 173/28 X |
| 3,442,338 | 5/1969 | Broderson | 173/28 X |
| 3,805,896 | 4/1974 | Bauer | 173/16 |
| 3,827,507 | 8/1974 | Lance | 173/15 |
| 3,835,940 | 9/1974 | Winter | 173/147 |
| 3,961,672 | 6/1976 | Welsch | 173/43 |

FOREIGN PATENT DOCUMENTS 560,857 4/1975 Switzerland.

*Primary Examiner*—Ernest R. Purser
*Assistant Examiner*—William F. Pate, III
*Attorney, Agent, or Firm*—Hill, Gross, Simpson, Van Santen, Steadman, Chiara & Simpson

[57] ABSTRACT

An improved portable hydraulically powered driving machine, for driving posts, ground anchors, concrete breakers, core drills, and the like work pieces into the ground, pavements or wall structure, has a tower in the form of a stanchion carried by an extensible pedestal mounted boom rig on a mobile base such as a conventional truck and in its working position is adapted to rest on the ground, pavement or wall structure at a controlled attitude relative thereto to guide a hydraulically powered hammer and hold an anvil against the work piece and, in its transporting position is adapted to be secured horizontally at a low level in a truck-mounted frame. The stanchion down-crowds the hammer guide to load a compression spring which maintains the anvil continuously against the work piece even after the impact force of the hammer blow is expended and the work piece advances a considerable distance. The hammer is also spring-loaded, a hydraulic jack lifts the hammer and stretches the spring and the stroke of the hammer together with the rapidity of the hammer blows is controlled by a rotating dump valve for the jack. The speed of rotation of the dump valve is controlled by the machine operator with faster speeds decreasing the stroke of the hammer and increasing the number of blows delivered per minute. Hydraulic controls are provided to accurately place the stanchion at the work site and to control the angle and direction in which the hammer blows are to be delivered. Air is introduced into the fluid return line from the dump valve for cushioning fluid flow.

20 Claims, 22 Drawing Figures

Fig. 7
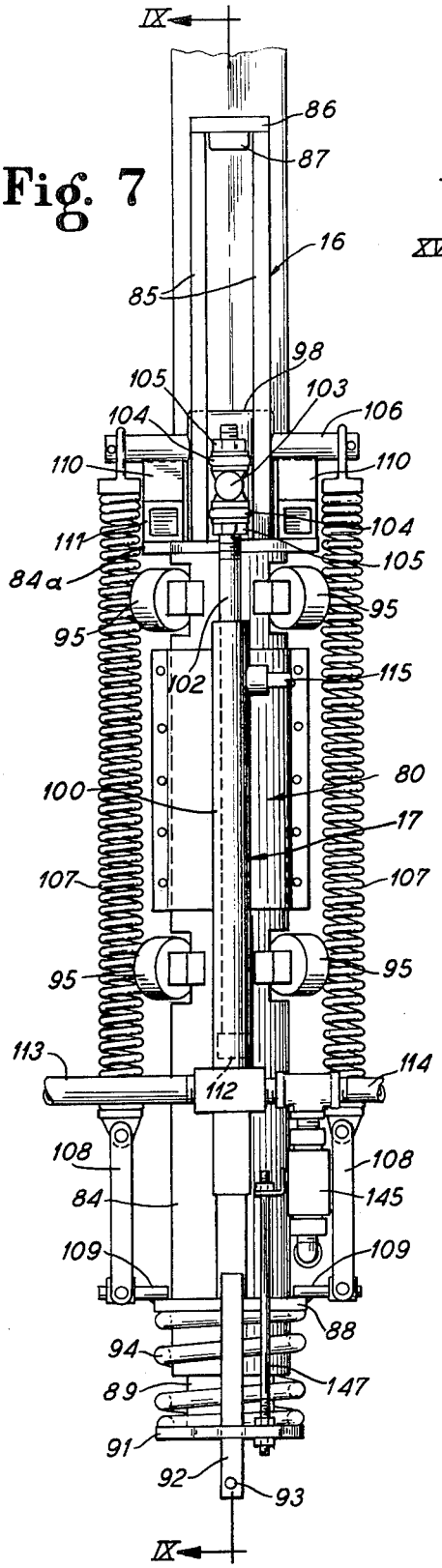
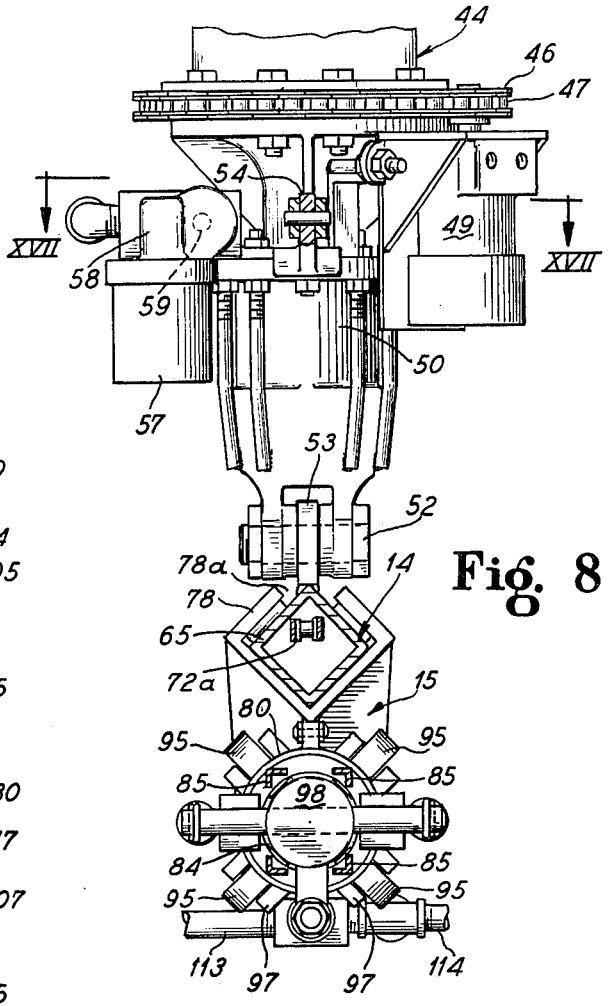
Fig. 8
Fig. 10
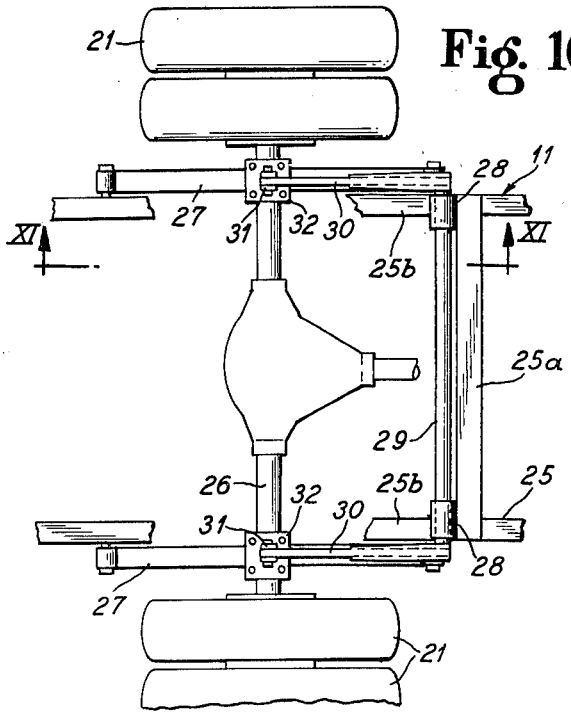

POST DRIVING MACHINE

RELATED APPLICATION

This application is a continuation-in-part of my copending U.S. patent application, Ser. No. 575,462, filed May 7, 1975, entitled "Post Driving Machine", now U.S. Pat. No. 4,050,526, issued Sept. 27, 1977.

SUMMARY OF THIS INVENTION

This invention improves the post driving machine of my aforesaid patent application, Ser. No. 575,462, now U.S. Pat. No. 4,050,526 by providing a stanchion type tower supporting and guiding a down-crowded carriage for the hydraulic hammer which is easily mounted on and removed from a boom structure carried from a truck. The boom structure preferably includes a pedestal mounted upright on the frame of a 1-ton open-top box body truck near the center of the box. A telescoped extensible boom assembly is carried at the top of the pedestal and is rotatable through a full 360°. The stanchion is detachably mounted on the free end of the boom by easily accessible fasteners. The pedestal also mounts a control station with an operator's seat that rotates with the boom. Hydraulic jacks or motors, raise, lower and swing the boom and tilt the stanchion in all directions relative to the boom. The truck has an upstanding frame mounted behind the cab supporting the boom and stanchion at a low level travel position and the truck frame rotatably supports a rigid transverse tube or bar with arms shackled to the rear axel springs of the truck to maintain the frame level with the ground under load from the boom thereby avoiding the necessity for outriggers. The operator's station is equipped with a sighting device showing the deviation of the stanchion from a vertical upright position. The stanchion carries a hammer guide or carriage suspending a spring-supported anvil and the carriage is hydraulically raised and lowered along the length of the stanchion to position the anvil for resting on top of the work piece and to compress the anvil spring to maintain the anvil continuously in contact with the work piece. The hammer is propelled by a tension spring and an upright hydraulic jack raises the hammer and stretches the spring to control the length of the hammer stroke. Fluid from the hydraulic jack is dumped by a rotating valve, the speed of which is accurately controlled from the operator's station to regulate the length and rate of the stroke of the hammer. On its hammer-lifting and spring-stretching cycle the hydraulic jack compresses air in the jack cylinder above the piston to flow out of the top of the jack into the conduit returning hydraulic fluid dumped from the rotating valve to the tank so that upon dumping of the fluid from the valve the air will cushion the surge of fluid and minimize shock loads on the return conduit. A safety hydraulic circuit is also provided to prevent operation of the lifting jack until the anvil spring is compressed.

It is then an object of this invention to improve the post driving machine of my aforesaid U.S. patent application, Ser. No. 575,462, filed May 7, 1975, now U.S. Pat. No. 4,050,526 by providing a stanchion type tower on the end of a an extensible boom supported on a mobile platform such as a truck body and adapted to rest on the ground to guide and down-crowd a hammer carriage suspending a spring-loaded anvil.

Another object of the invention is to provide a driving tool which is easily mounted on and removed from a truck or trailer mounted rig to load an anvil against a work piece, to guide the hammer relative to the work piece, to control the direction of impact and to maintain a continuous load on the work piece.

A further object of this invention is to provide a hydraulically powered post driving tool adapted to be easily attached to and demounted from a truck-mounted extensible boom type rig.

A further object of this invention is to provide a hydraulically powered spring propelled hammer assembly for a post driving tool which is controlled by a variable speed rotating dump valve.

A further object of this invention is to provide a hydraulic lift mechanism for the hammer of a post driving machine with an air cushion for dumped hydraulic fluid.

A still further object of this invention is to provide a truck-mounted post driving machine stabilized by a transverse rotatable tube on the truck which avoids the need for outriggers to hold the truck level during operation of the machine.

A further object of this invention is to provide an easily mounted stanchion type post driving machine with hydraulic mechanism controlling the attitude of the stanchion relative to the ground, down-crowding an anvil continuously against the work piece and controlling the stroke and rate of a hammer.

Other and further objects of this invention will become apparent to those skilled in this art from the following detailed description of the annexed sheets of drawings which, by way of a preferred example only, illustrate one embodiment of the invention.

ON THE DRAWINGS

FIG. 7 is a fragmentary rear elevational view of the post driving tool attachment of FIG. 5.

FIG. 8 is a top plan view with parts in horizontal section taken generally along the line VIII—VIII of FIG. 5.

FIG. 10 is a horizontal sectional view taken generally along the line X—X of FIG. 1 with parts broken away to show underlying structure.

BRIEF DESCRIPTION OF THE ILLUSTRATED EMBODIMENT OF THE INVENTION

The Machine in General

Figures 1, 2, 3, 4:
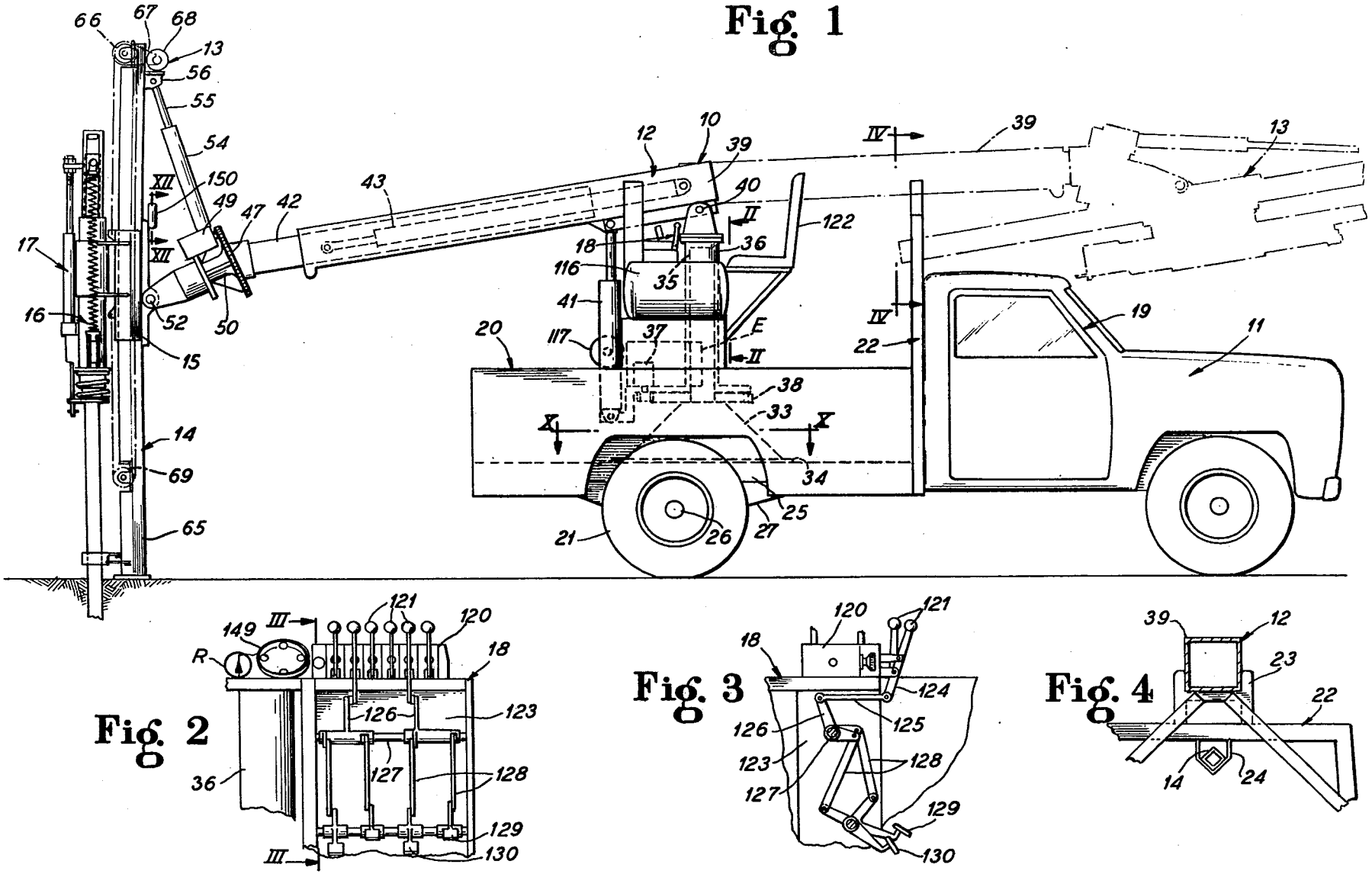
FIG. 1 is a side elevational view of a truck-mounted post driving machine according to this invention showing the operating position in solid lines and the low level travel position in dotted lines.
FIG. 2 is a fragmentary transverse elevational view of the control station of the machine taken generally along the line II—II of FIG. 1.
FIG. 3 is a fragmentary longitudinal view of the control station taken generally along the line III—III of FIG. 2.
FIG. 4 is a transverse sectional view, with parts and elevation, taken along the line IV—IV of FIG. 1.

As shown in FIG. 1, the driving machine 10 includes a standard automotive vehicle, such as an open box truck 11, a hydraulic derrick assembly 12 mounted on the truck 11, and a driving tool assembly 13 detachably mounted on the free end of an extensible boom of the derrick assembly 12.

The tool assembly 13 includes a stanchion type tower 14, a carriage 15 slidably mounted on the stanchion 14, a hammer housing and anvil support 16 mounted on the carriage 15 rearwardly of the stanchion 14, a hydraulic hammer lift mechanism 17, carried by the housing 16, and a hydraulic control system 18 operated from a station that rotates with the derrick assembly 12.

The Vehicle 11

As illustrated in FIG. 1, the vehicle 11 is a conventional three-quarter or 1-ton open-box truck with a driver's cab 19 at the front thereof and an open-top box body 20 at the rear thereof over the rear wheels 21. An upright inverted U-shaped frame 22 is mounted on the truck 11 behind the cab 19 and as shown in FIG. 4 has an open-top support 23 for the boom of the derrick assembly 12 and a depending strap receptacle 24 for the stanchion 14 of the tool assembly 13. The support 23 and strap 24 are mounted on the top bight portion of the U-shaped frame 22 midway between the side legs of the frame and as shown in FIG. 1, the frame 22 projects above the cab 19 just far enough so that the tool 13 will leave the windshield of the cab 19 unobstructed when the derrick 12 and tool 13 are in their stored travel position shown in dotted lines in FIG. 1 with the stanchion suspended in the strap 24.

Figure 11:
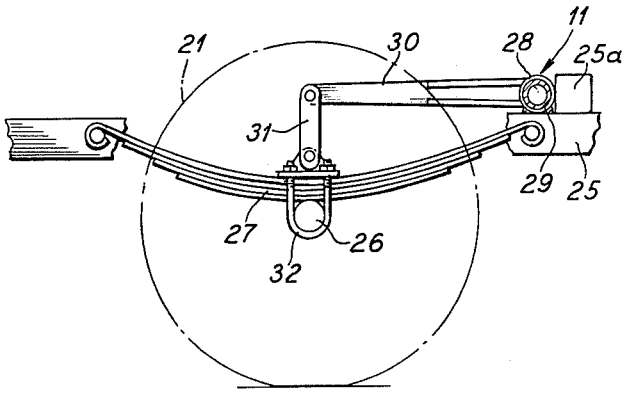
FIG. 11 is a vertical sectional view taken generally along the line XI—XI of FIG. 10.

As shown in FIGS. 1, 10, and 11, the truck 11 has a frame 25 from which a rear axle 26 for the rear wheels 21 is suspended by leaf springs 27. A cross frame brace 25*a* mounts sleeve bearings 28 adjacent the longitudinal frame beams 25*b* and a stiff torque resisting tube 29 is rotably mounted adjacent its ends in these bearings 28. If desired a single tubular bearing 28 could span the length of the cross frame 25*a* rotatably mount the tube 29 along its own entire length to prevent buckling of the tube under torsion loads. The ends of the tube 29 have rearwardly extending stabilizer arms 30 fixedly secured thereto and the rear ends of these arms 30 are connected through pivoted links 31 with spring shackle bolts 32 embracing the axle 26 and straddling the springs 27 at their mid points. P This arrangement of the tube 29, stabilizer arms 30 and links 31 accommodates flexing of the springs 27 to provide the spring suspension for the vehicle frame 25, but prevents the springs on one side of the truck from being flattened under load more than the springs on the other side of the truck, thereby stabilizing the truck frame against transverse tilting under load. This stabilizer arrangement avoids the necessity for outriggers on the truck 11 since the frame of the truck 25 cannot tilt laterally under the load of the derrick 12 and tool 13 and a stable platform for the derrick 12 is insured.

The Derrick 12

As shown in FIG. 1, the derrick 12 has a pedestal mounting 33 supported from the truck frame 25 on a base plate 34. A hole is cut through the box body 20 so that the base plate 34 may be bolted directly to the frame 25 and the pedestal 33 permitted to project into the body 20 at about the mid point thereof over the rear wheels 21. An upright inner mast or spindle 35 projects from the pedestal base 33 and rotatably mounts an outer mast or sleeve 36 which is rotated by hydraulic motor 37 through a worm and ring gear drive 38.

The operator's station 18 is mounted on one side of the outer mast or sleeve 36 and the upper end of the mast supports the inner end of a lower boom 39 on a horizontal pivot 40. This lower boom 39 is raised and lowered about the pivot 40 by a hydraulic jack 41 supported from the base of the mast 36. The lower boom 39 is hollow and telescopically mounts an upper boom 42 which is propelled into and out of the boom 39 by a hydraulic jack 43.

The mast sleeve 36 mounts the derrick booms 39 and 42 for a full 360° rotation around the mast 35 of the pedestal mounting 33 and the operator's station 18 rotates therewith so that the operator is always facing the tool 13 mounted on the free end of the boom 42. The lower boom 39 is swingable on its pivot base 40 from a substantially vertical high-lift position to a lower than horizontal position as shown in FIG. 1 and the hydraulic jack 41 is effective to load the boom assembly downwardly for pressing the stanchion 14 of the tool 13 tightly against the ground.

To swing the tool 13 from its ground supported upright position rearwardly of the truck shown in FIG. 1 to any other operating position, the boom 39 is merely lifted to raise the stanchion 14 off the ground and rotated to the desired work site which could be on either side of the truck or even above the truck. To move the derrick 12 and the tool 13 to the low-level storage position for travel, as shown in dotted lines in FIG. 1, the tool is tilted back under the boom 39 and manipulated to move the stanchion 14 into the strap 24 whereupon the boom 39 may then be lowered into the support 23.

The Driving Tool 13

Figures 5, 5A, 5B, 6:
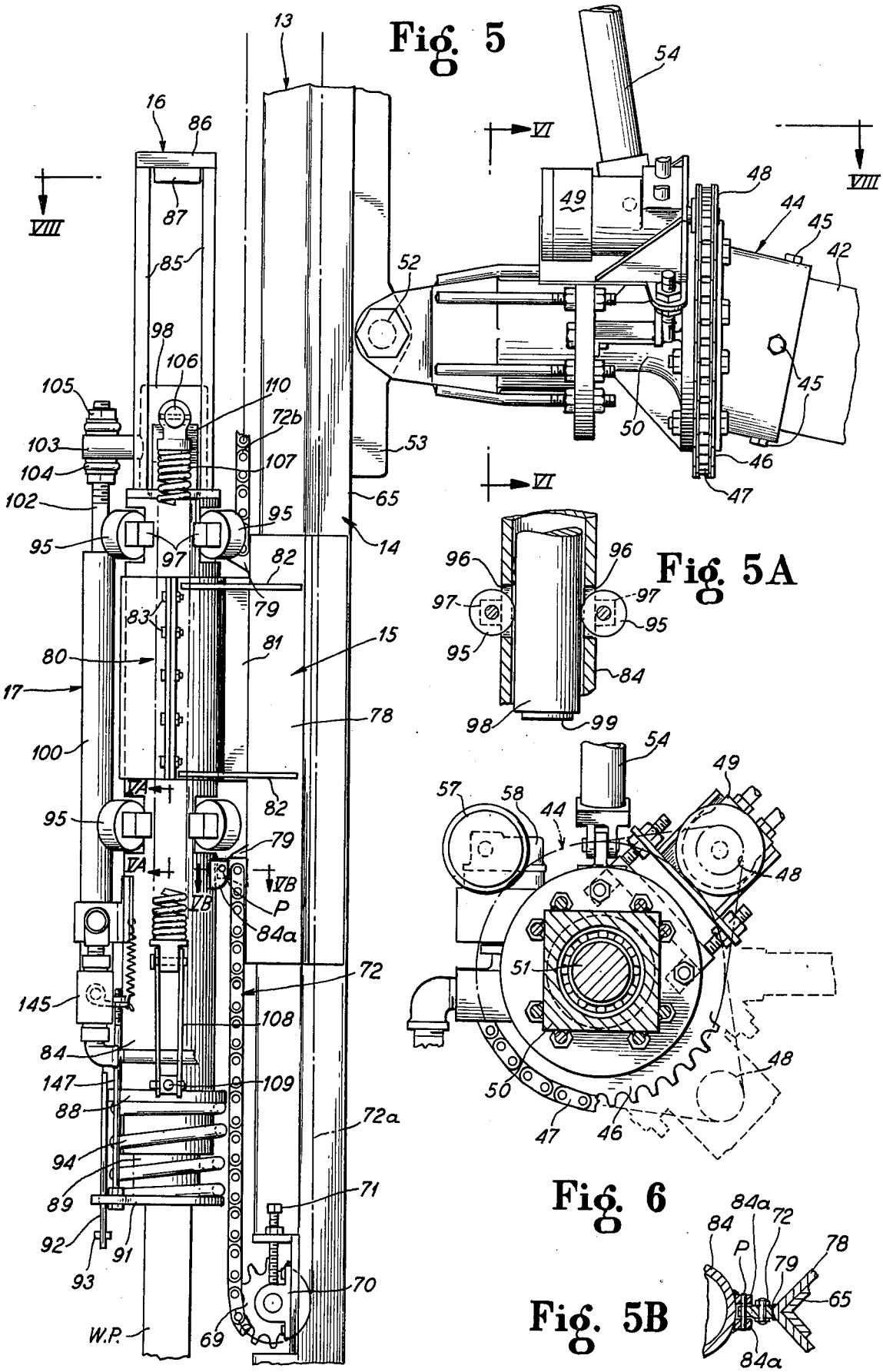
FIG. 5 is a fragmentary side elevational view of the free end of the boom of the machine of FIG. 1 and the post driving tool detachably mounted thereon.
FIG. 5A is a fragmentary cross-sectional view generally along the line VA—VA of FIG. 5 but displaced from this line to extend through the roller axes.
FIG. 5B is a fragmentary horizontal cross-sectional view along the line VB—VB of FIG. 5.
FIG. 6 is a transverse sectional view along the line VI—VI of FIG. 5.

As shown in FIG. 5, the tool 13 is detachably mounted on the end of the upper boom 42 by a cap unit 44 fitting over the free end of the upper boom 42 and secured thereto by bolts 45. This cap 44 as also shown in FIGS. 6 and 8, has a fixed ring gear 46 around which is meshed a sprocket chain 47 which is also trained around the driven gear 48 of a hydraulic motor 49 which is mounted on a head 50 that is rotatable around a spindle 51 extending from the cap 44 as shown in FIG. 6. The arrangement is such that the chain 47 is held stationary by the cap 44 and when the gear 48 is driven, the motor pulls the head 50 around the spindle 51.

The rear end of the head 50 is pivoted by a pin 52 to a rearwardly projecting rib 53 of the stanchion 14. Four bolts 45 positioned in diametrically opposite pairs are sufficient to secure the cap 44 to the boom 42 and are easily accessible for removal to detach the tool 13 from the boom 42.

A hydraulic jack 54 is pivotally mounted on the head 50 and as shown in FIG. 1, has its piston rod 55 pivoted to a bracket 56 projecting from the front side of the stanchion 14 adjacent the upper end of the stanchion. This jack 54 is effective to tilt the stanchion forwardly and rearwardly while the hydraulic motor 49 is effective to rotate the stanchion on the end of the boom 42. In this manner the attitude of the stanchion 14 relative to the ground or other surface to be impacted is accurately controlled.

Figure 17:
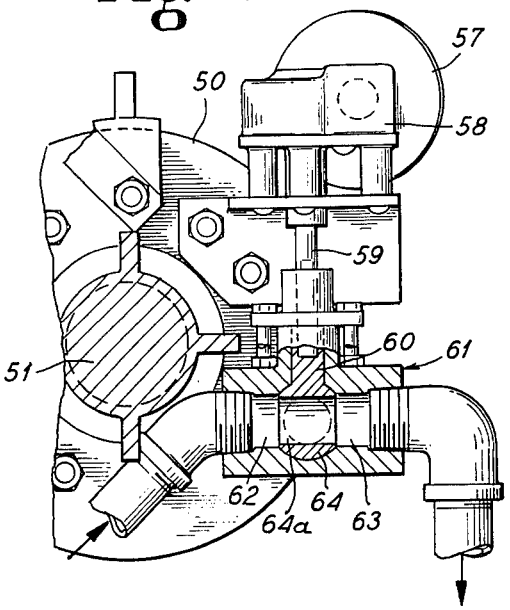
FIG. 17 is a transverse cross-sectional view taken along the lines XVII—XVII of FIG. 8.
Figure 18:
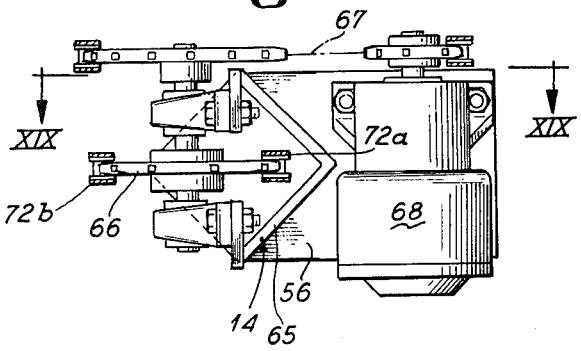
FIG. 18 is a top plan view of the stanchion showing the motor drive for down-crowding.
Figure 19:
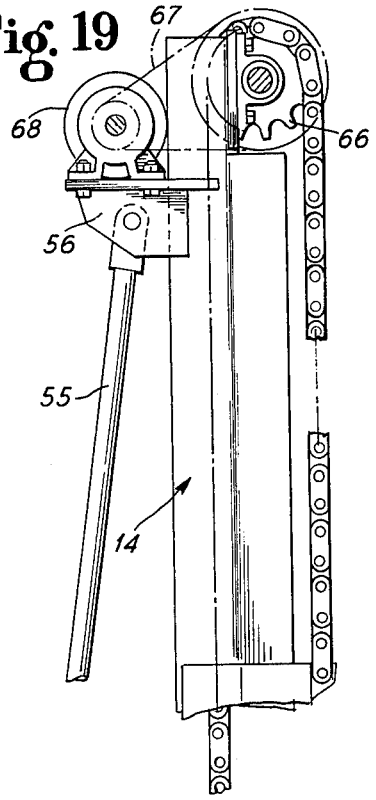
FIG. 19 is a side elevation along the line XIX—XIX of FIG. 18.

As shown in FIGS. 6, 8 and 17, the head 50 supports a second hydraulic motor 57 driving reducing gears (not shown) in a gear box 58 having an output shaft 59 which, as shown in FIG. 17, is coupled to a shaft 60 of a ball valve 61. The ball valve 61 has a housing with an inlet 62 and an outlet 63 together with a ball chamber between the inlet and outlet forming a socket for a ball 64 rotated by the shaft 60. The ball 64 has a bore 64*a* therethrough joining the inlet 62 with the outlet 63. When the ball valve 64 is rotated 90° from the position shown in FIG. 17, it closes communication between the inlet and outlet. The arrangement is such that when the ball 64 is rotated a full revolution, the valve 61 will perform two opening and two closing cycles. The speed of rotation of the ball 64 thus controls the rate of the opening and closing cycles.

The Stanchion Tower 14

As shown in FIGS. 8, 9, 14 and 15, the stanchion 14 is a hollow square post 65 with a rear corner facing the carriage 15 and a front corner facing the head 50.

As shown in FIGS. 1, 18, 19 and 20 the top end of this post 65 rotatably supports a sprocket 66 driven by a chain 67 from a hydraulic motor 68 mounted on the bracket 56 which projects from the rear corner of the post 65.

As shown in FIGS. 1, 5, 9 and 20, the stanchion post 65 also rotatably mounts a sprocket 69 near the bottom end thereof on bearing blocks 70 that are vertically adjustable by a screw adjustment 71. The sprocket 69 is aligned with the top sprocket 66 and extends through a window cut through the rear corner of the stanchion post 65.

A sprocket chain 72 is trained around the sprockets 66 and 69 and has an inner run 72*a* extending through the hollow stanchion post 65 (FIG. 18) and an outer run 72*b* outside of the stanchion post over the rear corner thereof.

Figure 9:
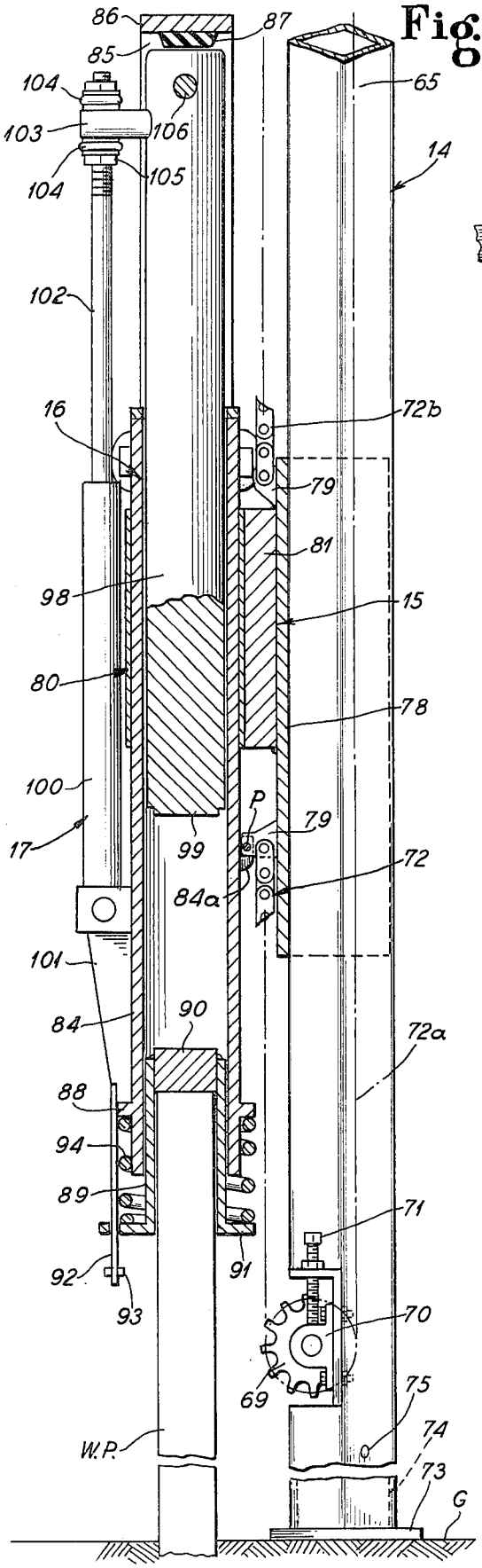
FIG. 9 is a fragmentary longitudinal sectional view with parts in elevation taken along the line IX—IX of FIG. 7.
Figure 14:
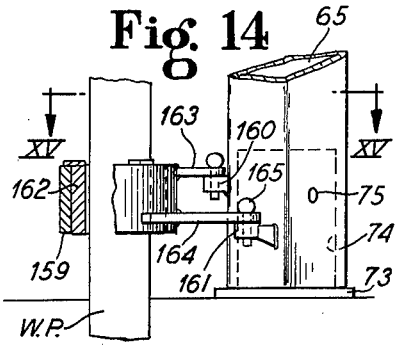
FIG. 14 is a fragmentary side elevational view of the lower end of the stanchion carrying a removable foot plate and post guide.
Figure 15:
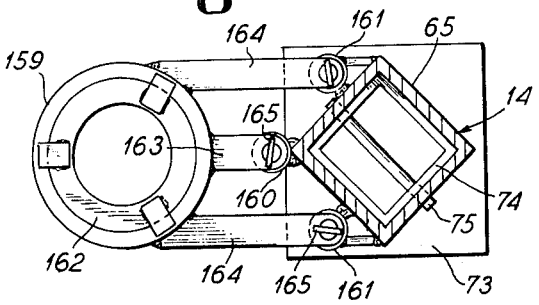
FIG. 15 is a horizontal sectional view, with parts in top plan, taken along the lines of XV—XV of FIG. 14.

The bottom of the post 65, as shown in FIGS. 9, 14 and 15 has an enlarged foot plate 73 mounted thereon to rest on the ground G. This foot plate 73 has an upstanding square tube 74 centered thereon and slidably fitting the post 65.

A removable pin 75 extends through aligned holes in the post 65 and tube 74 to secure the foot plate to the bottom of the post.

Figure 16:
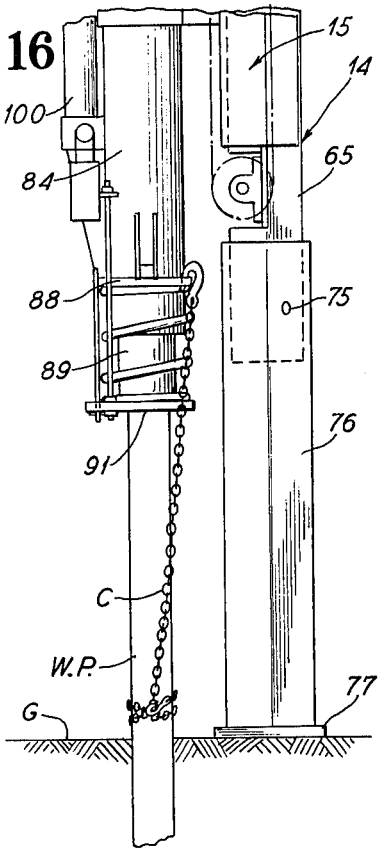
FIG. 16 is a fragmentary elevational view of the lower end of the stanchion on which a foot plate with an elongated leg portion is mounted to increase the height of the stanchion when resting on the ground.

As shown in FIG. 16, the effective length of the post 65 is increased by removing the foot plate tube 74 from the bottom end of the post 65 and replacing it with an extension tube 76 that fits over the bottom end of the post 65 and is secured thereto by the same pin 75 used for the tube 74. This extension post 76 has a foot plate 77 on the bottom end thereof adapted to rest on the ground G so that when the tool 13 is to be used for driving long posts or other work pieces into the ground, it can be extended to any desired height by use of variable lengths of extension of tubes 76.

The carriage 15

The carriage 15, as shown in FIGS. 5, 8 and 9 has a square hollow tube 78 slidably mounted on the post 65 with a slot or cleft gap 78*a* (FIG. 8) in its front corner accommodating free passage of the rib 53 therethrough. This tubular base 78 is only a fraction of the length of the post 65 so as to have an extended travel length from the bottom to the top of the post 65.

As shown in FIGS. 5 and 9, the outer run 72*b* of the chain 72 is anchored to brackets 79 at the top and bottom ends of the carriage tube 78. The chain thus drives the tubular base 78 of the carriage along the length of the tubular post 65.

An upstanding sleeve 80 is carried by the carriage base tube 78 from a rib 81 secured on the rear corner of the base 78 and from welded-on bracket plates 82 at the top and bottom ends of this rib 81, as shown in FIGS. 5 and 9. The sleeve 80 is formed in two longitudinal halves bolted together by bolts 83 extending through mating flanges provided on these halves. The arrangement is such that the outer half can be removed from the inner half of the sleeve 80 to premit installation of the hammer housing as hereinafter described.

The Hammer Housing and Anvil Support 16

As shown in FIGS. 5 and 7 to 9, the hammer housing and anvil support 16 include a tubular barrel 84 extending through the tubular bracket sleeve 80 and fixedly clamped therein so as to parallel the stanchion post 65 and travel with the carriage base 78. As shown in FIGS. 5, 5A and 9 to further lock the barrel 84 to the base 78 and prevent sliding of the barrel in the sleeve 80, the bracket 79 at the bottom end of the carriage tube 78 extends between two lugs 84*b* welded on the barrel 84 and a removable pin P extends through mating holes in the lugs and bracket. The pin P is removed when the outer half of the bracket sleeve 80 is removed so that the barrel may be removed from the carriage.

The top end of the barrel 84 projects above the tubular bracket 80 and has four angle iron legs 85 extending upwardly therefrom to a cap 86 with a rubber bumper 87 on its lower face.

The bottom of the barrel 84 projects below the tubular mounting sleeve 80 and has an out-turned flange 88 spaced from its open bottom end. A sleeve 89 is slidably mounted in this open bottom end of the barrel 84 and has an anvil head 90 (FIG. 9) secured in its upper end thereof. The bottom of the sleeve has an out-turned flange 91 and rods or straps 92 suspended from the flange 88 of the barrel fit freely through holes in the flange 91. Pins or nuts 93 on the bottom ends of these straps or rods receive the flange 91 thereagainst to maintain the sleeve 89 in the barrel 84. A compression coil spring 94 surrounds the bottom end of the barrel 84 and has its ends abutting the flanges 88 and 91. Three or four rods or straps 92 spaced equally around the barrel 84 are sufficient to slidably suspend the sleeve 89 from the barrel.

As shown in FIG. 9, a work piece W.P. extends into the sleeve 89 with the anvil head 90 resting on the top thereof. When, as hereinafter described, the carriage 15 is down-powered to move the barrel 84 for pressing the anvil head 90 against the work piece W.P., the spring 94 will be compressed and will be effective to maintain the anvil head 90 constantly against the work piece.

The barrel 84 as shown in FIGS. 5, 5A, 7 and 8 rotatably supports two sets of four rollers 95 arranged symetrically around the barrel with the first set being at a level adjacent the top of the barrel and the second set being at a lower level but above the bottom of the barrel. Each roller 95 is rotatable about an axis transversely of the barrel and projects through a slot 96 (FIG. 5A) in the barrel 84 so that it will present a rolling face interiorly of the barrel. The rollers 95 are supported on axles carried by ears 97 projecting from the barrel on each side of each roller.

A heavy hammer 98 of circular cross section and substantial length fits freely in the barrel 84 and rides on the rollers 95 as best shown in FIGS. 5A and 9. The hammer 98 preferably has a reduced diameter hardened leading end 99 for impacting against the anvil 90. The stroke of the hammer in the barrel 84 is between this anvil 90 and the top bumper 87 depending from the cap 86 supported in spaced relation from the top of the barrel 84 by the angle iron legs 85. The relative lengths of the barrel 84 and hammer 98 are such that the top end of the hammer 98 will always project above the top of the barrel 84.

The Hammer Lift Mechanism 17

The hammer lift assembly 17 as shown in FIGS. 5, 7 and 9 includes an upright hydraulic jack 100 having the lower end of its cylinder supported on a bracket 101 mounted on the barrel 84 and having its piston rod 102 extended through a pin 103 projecting rearwardly from the top end of the hammer 98. The piston rod 102 has rubber grommets 104 therearaound on opposite sides of the pin 103 and nuts 105 threaded on the rod 102 clamp these grommets relative to the top and bottom sides of the pin 103.

A second pin 106 extends laterally through the top end of the hammer 98 and tension springs 107 are suspended from the ends of this pin 106, straddling the suppot sleeve 80 and barrel 84 and pinned at their lower ends to links 108 which in turn are pivotally mounted on laterally extending supports 109 welded to the barrel flange 88.

To provide a rest position for the hammer causing it to follow the carriage as it is raised and lowered, bumpers 110 of resilient material are mounted on supports 111 carried on a top flange **84*a* of the barrel 84 to receive the pin 106 thereagainst. The springs 107 hold the pin 106 against the bumpers 110 in the idle position of the hammer but in the operating position the carriage down-crowds the anvil head 90 against the work piece to compress the spring 94 so that the hammer 98 will strike the anvil head before the pin 106 reaches the bumpers 110. The pin 106, of course, extends freely between the legs 85 carried by the barrel 84**.

As shown in FIG. 7, the lift jack 100 has the piston rod 102 extending into the jack cylinder to a piston head 112 and pressured fluid from a feed pipe 113 is fed into the cylinder under the piston 112 and is relieved from the cylinder through a discharge pipe 114. In addition an air conduit 115 is provided at the upper end of the cylinder 100 to receive air from the cylinder above the piston 112 as the piston is raised in the cylinder. Thus, when fluid is forced into the cylinder below the piston 112, air will be forced into the air line 115. Conversely, when fluid is dumped from the cylinder under the piston 112, the stretched springs 107 will impel the hammer to deliver its blow against the anvil head 90 and at the same time air will be sucked from the air line 115 into the cylinder above the piston 112.

Alternative Hammer Housing, Anvil Support and Lift Mechanism

If desired, the hammer housing and anvil support 16 and the hydraulic mechanism 17 can be replaced with a self-contained driver tool such as a standard air, hydraulic, electric or gas-driven hammer or breaker tool. To this end, the sleeve 80 is opened up by removal of the bolts 83 and the pin P is removed permitting removal of the barrel 84 and the barrel carried components. Then, for example, the barrel or housing of a standard air hammer or breaker tool can be clamped in the sleeve 80 and pinned to the carriage base 78. The barrel or housing of the standard air hammer tool suspends the spring-loaded anvil sleeve 89 so that the anvil 90 will be impacted by the hammer or other driven impact members in the driver tool. The power for driving this type of tool can be supplied from any suitable source such as an air compressor which may be mounted on the vehicle 11. The carriage 15 can be down-crowded to lower the anvil head against the work piece or against a tool such as a breaker chisel to be driven by the hammer.

The compressing of the spring 94 by the weight of the driver tool and the down-crowding load applied thereto from the carriage 15 will, as explained above, not only maintain the anvil head against the work piece or breaker, but will continue to load the work piece or tool and avoid the "pogo stick" recoil encountered with hand manipulated air hammers or jacks. The stanchion post 65 will, of course, rest on the surface being impacted by the work piece or breaker tool and will be positioned at a controlled attitude relative to this surface for guiding the direction of the driving of the work piece or tool.

The Hydraulic Control System 18

Figure 20:
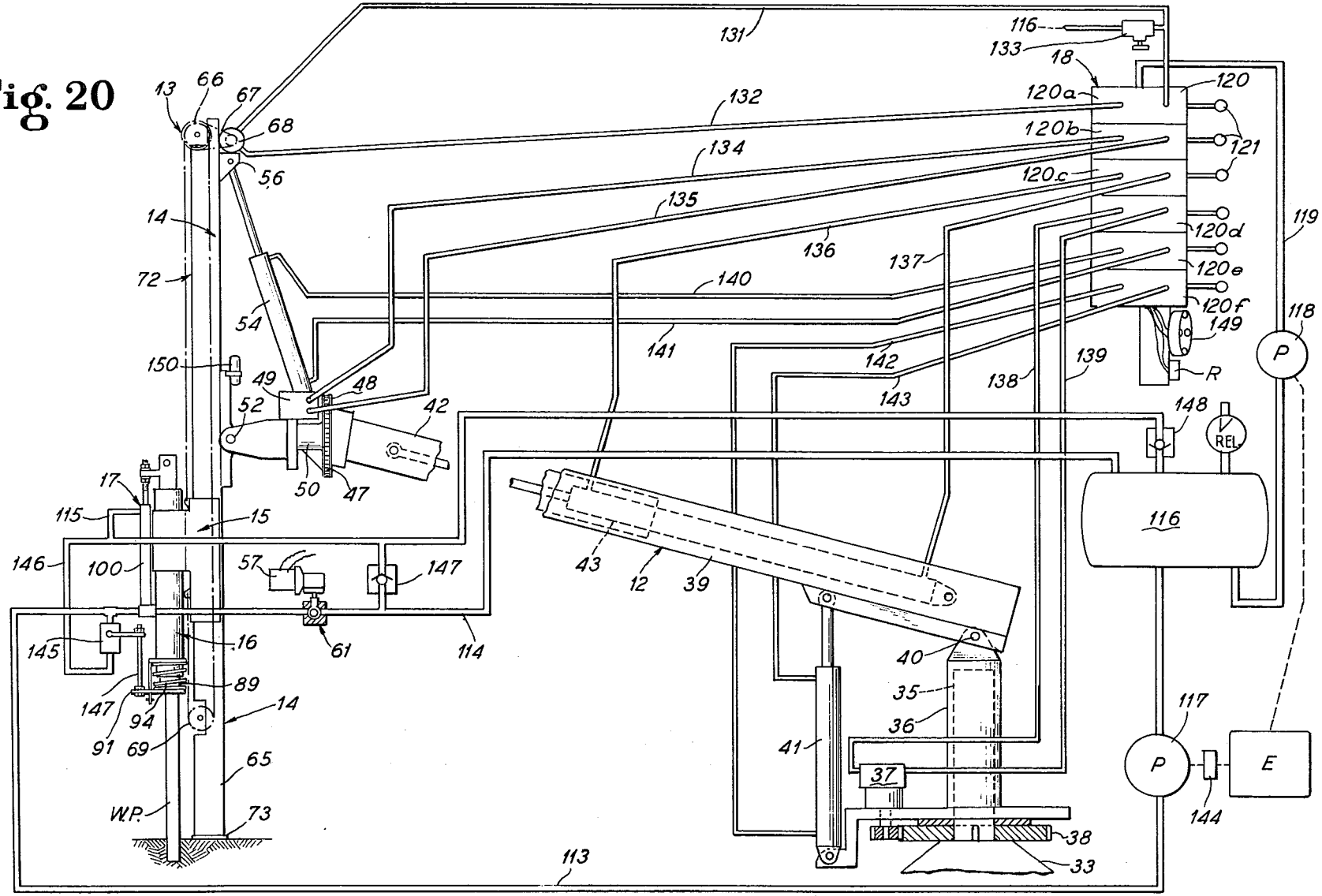
FIG. 20 is a diagrammatic view of the hydraulic control system for the machine.

As shown in FIG. 20, a supply tank 116 feeds hydraulic fluid to a main pump 117 driven by an auxiliary engine E. This engine and the tank 116 are supported on the outer mast 36 of the pedestal mounting for the derrick assembly 12 as shown in FIG. 1. A second hydraulic pump 118 is also driven by the engine E. The pump 117 has a large capacity of about 26 gallons per minute and is used exclusively for the hydraulic lift mechanism 17. The pump 118 may have a smaller capacity of about 7 gallons per minute and serves the hydraulic derrick assembly 12, the tilting and rotating hydraulic controls for the stanchion 14 and the carriage mechanism 15.

A supply conduit 119 from the pump 118 feeds the manifold of a valve bank 120 containing six valves **120*a* through 120*f*, each controlled by a separate hand lever 121 from the operator's station 18 which as described above in connection with the derrick system 12, is mounted on the outer mast or sleeve 36. This operator station 18 includes an operator's seat 122 shown in FIG. 1 and a console 123 shown in FIGS. 2 and 3 in front of the seat 122. As shown, two of the hand levers 121 have depending arms 124 connected by links 125 to cranks 126 independently rotatable on a console carried cross shaft 127. Each crank 126 is connected through two links 128 to two foot pedals 129 and 130. One pedal is depressed to lift a link 128 while the other pedal is depressed to lower a link 128 thereby rocking each crank 126 in opposite directions to pull and push the valve levers 121. The arrangement is such that the levers 121 having these foot pedal connections can be manipulated by the feet of the operator leaving his hands free to manipulate the other control levers 121**.

As shown in FIG. 20 the valve 120*a* supplies pressurized fluid through a conduit 131 to the hydraulic motor 68 which drives the sprocket 66 and chain 72 for controlling the down-loading of the carriage assembly 15. Fluid from the motor 68 is discharged back to the valve through the conduit 132 on this down-load cycle. The valve 120*a* can be reversed to feed fluid through the conduit 132 for reversing the motor 68 to raise the carriage assembly. A bleeder valve 133 at the operator's station 18 is manually controlled to bleed pressurized fluid from the conduit 131 back to the tank 116 for accurately controlling the downward loading of the carriage assembly 15.

The valve 120*b* controls flow of fluid through conduits 134 and 135 to the hydraulic motor 49 for controlling the direction of rotation of the motor drive sprocket 48 thereby controlling the direction of rotation of the head 50 on the end of the boom 42.

The valve 120*c* controls flow of fluid through conduits 136 and 137 to the hydraulic jack 43 for driving the boom 42 in both directions into and out of the boom 39 thereby controlling the effective length of the derrick assembly 12.

The valve 120*d* controls fluid through conduits 138 and 139 to drive the motor 37 in opposite thereby controlling the direction of rotation of the outer sleeve or mast 36 and thus controlling the direction of the derrick booms 39 and 42 relative to the vehicle 11.

The valve 120*e* controls fluid flow through the conduits 140 and 141 to control the jack 54 for tilting the stanchion tower 14 about the pivot 52.

The valve 120*f* controls hydraulic flow through conduits 142 and 143 to actuate the boom lifting jack 41 in both directions including a down-loading of the boom.

From the above descriptions, it will be understood that the pump 118 supplies the hydraulic fluid through the valve bank 120 for supplying hydraulic power to all of the hydraulic components with the exception of the hammer lift mechanism 17. This pump 118 is driven whenever the auxiliary engine E is operated in order that hydraulic power will be available to manipulate the derrick 12, and the devices for positioning the tool assembly 13 relative to the derrick assembly. On the other hand, the high-flow capacity pump 117 is only driven when the hammer is in operation and therefore a clutch 144 is provided between the engine E and the pump 117. This clutch can take the form of a loose belt pulley drive where the belt is tightened whenever it is desired to drive the pump 117.

The pump 117 supplies hydraulic fluid under pressure through the conduit 113 feeding the bottom end of the hydraulic lift jack 100 as explained hereinabove. This fluid is then returned through the discharge conduit 114 under the control of the dump valve 61 described above.

A by-pass valve 145 is provided in the conduit 113 ahead of the lift jack 100 to by-pass fluid back to the tank 116 through a return conduit 146. The valve 145 is controlled by the spring loaded anvil 89 by a link 147 attached to the flange 91 of the anvil sleeve 89 so that fluid is by-passed from the feed conduit 113 to the return conduit 146 until the anvil is loaded against a work piece W.P. by down-crowding the carriage assembly 15 to compress the anvil spring 94 and thus hold the anvil head constantly against the work piece as described hereinabove. By-passed fluid in the return conduit 146 flows through a check valve 147 into the return conduit 114 back to the tank 116. The check valve 147 is downstream from the dump valve 61.

Air flow into and out of the top end of the lift jack 100 above the piston, as explained above, is accommodated through the air line 115 which, as shown in FIG. 17, communicates with the return conduit 146 which extends to a check valve 148 on the top of the tank 116. The check valve 148 opens to admit air from the tank into the top of the jack 100 on the downstroke of the jack but locks air in the conduit 146 on the upstroke of the jack, thereby forcing this air through the check valve 147 into the return conduit 114. The tank 116 is thus maintained under an elevated pressure and the conduit 114 will be loaded with air downstream from the dump valve 61 so that when this valve is open, the dumped fluid from the bottom of the lift jack 100 will discharge against an air cushion to lessen surging and shock loads on the fluid conduits. The air cushioning effect is obtained without any added component since it is developed by the same hydraulic jack 100 that is used to lift the hammer 98 and stretch the springs 107.

The Sighting Device 149

In order to facilitate accurate control of the attitude of the stanchion tower 14 from the operator's station at the console 123, as shown in FIGS. 2 and 17, a sighting device 149 is mounted on the console of the operator's station and this device cooperates with a tilt switch 150 mounted on the front end edge of the stanchion post 65.

Figure 12:
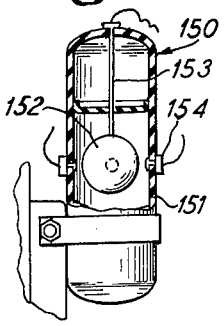
FIG. 12 is a vertical sectional view, with parts in elevation, of a tilt switch attached to the stanchion and taken generally along the lines XII—XII of FIG. 1.
Figure 13:
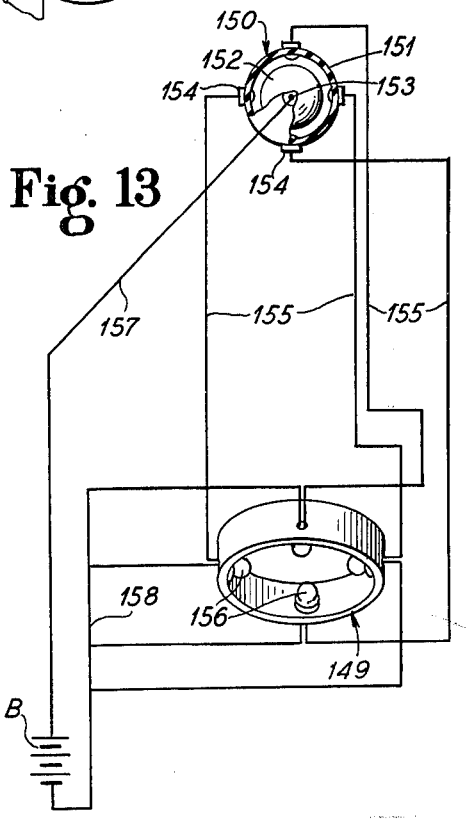
FIG. 13 is a top plan view of the tilt switch of FIG. 12 with parts in transverse section and a wiring diagram illustrating the manner in which the switch is connected to a sighting device at the operator's station.

As shown in FIGS. 12 and 13, this tilt switch 150 has a plastic casing 151 with a domed top from which is suspended a heavy metal ball 152 by means of a metal flexible wire or cable 153.

The side wall of the casing 151 carries four electrical contacts 154 surrounding the ball 152 with each contact being connected through a wire 155 with a light bulb 156 in the sighting device 149. Electrical energy from a suitable source such as a battery B supplies current to the ball 152 through a wire 157 and the cable 153. When the ball 152 swings to engage a contact 154, current flows through the wire 155 of this contact to the filament in the corresponding bulb 156 and then flows from the filament back through a wire 158 to the battery B.

One pair of contacts 154 is aligned transversely of the stanchion post 65 to be engaged by the ball when the post is tilted laterally. The direction of tilt is that indicated by one of the laterally arranged light bulbs 156. The other set of contacts 154 is aligned so as to be engaged by the ball 152 when the stanchion post 65 is tilted forwardly or rearwardly and these contacts in turn energize the top and bottom light bulbs 156 in the sighting device 149. Thus, the operator has an immediate reading of the lateral or longitudinal tilt of the stanchion and can easily manipulate the valve 120*b* to actuate the hydraulic motor 49 for correcting lateral tilt or the valve 120e to actuate the jack 54 for controlling front and rear tilt of the stanchion post.

The Work Piece Guide 159

As shown in FIGS. 14 and 15, the stanchion post 65 carries a removable collar 159 beyond the rear edge thereof to receive the work piece W.P. This collar is supported from a rearwardly projecting eye socket 160 projecting rearwardly from the rear corner of the post 65 and similar eye sockets 161 on the side walls of the pot laterally of the socket 160 but at a lower level. The work piece post guide collar 159 has a cylindrical bore of sufficiently large diameter to accept removable bushings 162 with variably sized internal diameters and shapes for slidably receiving work pieces of different sizes and shapes. The collar has a top leg 163 adapted to overlie the socket 160 and side legs 164 adapted to overlie the sockets 161. The ends of these legs 163 and 164 are apertured to accept connector pins 165 which extend through the sockets and mount the guide collar 159 in a horizontal plane rearwardly from the lower end of the stanchion post 65.

The guide collar 159 is thus easily mounted on and removed from the stanchion post 65 and can accept bushings of different internal diameters and sizes to slidably guide work pieces adjacent the ground level. With the upper end of the work piece also mounted in the anvil sleeve 89, the work piece is thus held parallel with the stanchion post 65.

Operation of the Machine

From the above descriptions it will be understood that the driving machine 10 of this invention, being mounted on a mobile vehicle 11 can be driven to the work site with the derrick 12 and driving tool 13 at a low-level carry position shown in dotted lines in FIG. 1. In this low-level position, the boom 42 is firmly seated in the support 23 of the frame 22 and the free end of the stanchion 14 is suspended in the strap 24. At the work site the derrick boom 42 is extended from the boom 43 to retract the stanchion 14 from the strap 24 and the derrick is then raised and swung to position the stanchion 14 at the exact spot where the work piece is to be driven.

It is preferred to down-load the derrick to hold the foot plate 73 of the stanchion post 65 tightly against the ground, wall or other surface to receive the work piece. The attitude of the stanchion relative to the ground is then carefully adjusted so that the work piece will be driven in the exact desired direction. Next, the carriage assembly 15 is raised on the stanchion post 65 so that the upper end of the work piece can be inserted in the anvil sleeve 89 with the anvil head 90 resting on top of the work piece. The carriage is then powered downwardly on the stanchion post 65 to compress the coil spring 94 of the anvil thereby closing the by-pass valve 145. Hydraulic fluid then flows into the lower end of the lifting jack 100 to raise the hammer 98 in its guide barrel 84.

The dump valve 61 is driven by the electric motor 57 at an exact speed controlled by the operator from a rheostat R or the like current regulator mounted on the console 123. The motor 57 could also be hydraulically driven with a bleeder control such as the control 133 for the motor 68. When the valve is closed, fluid will flow under the piston in lifting jack 100 to raise the hammer and this lifting action will continue until the valve is opened to dump the hydraulic fluid. The speed of rotation of the dump valve thus controls the height to which the hammer is lifted and cooperates with the speed of the pump 117 to create a desired impact rate for the hammer.

On the lifting stroke, the hammer stretches the springs 107 and then when the dump valve 61 is opened the lifting force on the hydraulic lifting cylinder 100 is released permitting the springs and gravity to propel the hammer against the anvil head 90 to deliver its driving blow to the work piece W.P.

During the lifting cycle, air above the piston in the lifting cylinder 100 is compressed into the hydraulic fluid return conduit downstream from the dump valve 61 so that on the next succeeding dumping of the fluid, an air cushion will be provided to minim shock loads in the conduit.

After the hamming delivers its impact blow against the anvil to drive the work piece into the ground, the hydraulic load on the carriage 15 is maintained at a sufficient level so that the carriage will be down-crowded to follow the work piece and cause the anvil head 90 to remain in contact therewith. Any lag in this down-crowding follow-up will be accommodated by the compression spring 94 which can elongate from its compressed condition to maintain the anvil head against the work piece during the follow-up movement of the carriage. The down-crowding load is controlled by the bleeder vavle 133.

The vehicle 11 stabilized against a lateral tilt as when the derrick operates the driving tool laterally of the vehicle body without resorting to the use of outriggers, by the stabilizer arms 30 secured to the ends of the rigid rotating tube 29 carried by the vehicle frame. These stabilizer arms prevent flattening of the vehicel springs 27 on one side of the vehicle more than on the other side but operate in unison to accommodate spring suspension of the rear wheels of the vehicle.

While the driving tool 13 is especially adapted for driving posts into the ground, it is also useful to pull work pieces from the ground as shown in FIG. 16 by anchoring a cable C around the work piece W.P. and attaching the cable to the flange 88 of the barrel 84 whereupon the carriage assembly 15 can be powered to lift the barrel 84 to pull the work piece W.P. out of the ground.

Instead of driving work pieces into the ground or pulling work pieces from the ground, the tool 13 is also useful to drive demolition tools into pavements, walls, abutments and the like. Thus the derrick can be manipulated to carry the tool 13 to an overhead position and press the stanchion foot 73 against a wall, abutment, or the like. A demolition tool such as a chisel can be fitted in the anvil sleeve 89 in place of the work piece W.P. to be impacted by the hammer 98 for driving, causing the wall or the like to collapse away from the vehicle. Likewise, the stanchion 14 can be manipulated to extend at an angle relative to the surface to receive the work piece, thereby driving the work piece in any desired direction.

It should thus be understood that the invention provides a universal easily transportable hydraulic driving tool accurately controlled by a single operator who at all times has a full view of the driving operation.

I claim as my invention:

1. A mobile hydraulic driving machine which comprises a wheeled vehicle having a frame, a pedestal mounted on and supported by said frame having an upright mast, a sleeve rotatable on said mast, a lower derrick boom pivoted on the upper end of said sleeve, an upper derrick boom telescoped in said lower boom, a driving tool removably mounted on the end of the upper boom beyond the end of the lower boom, means for rotating said sleeve to position the derrick boom circumferentially of the vehicle, means for extending and retracting the upper boom to space the driving tool relative to the vehicle, said driving tool having an adjacent upright post with a foot adapted to rest on the ground, means for controlling the attitude of said post relative to the upper derrick boom, a carriage slidable on the post, a hammer guide mounted on the carriage, a spring-loaded anvil depending from the hammer guide, a hammer slidable in said hammer guide adapted to impact against the anvil, a hydraulic lift mechanism for said hammer, tension springs stretched by said lift mechanism for propelling the hammer against the anvil, a dump valve for said mechanism having open and closed cycles, means controlling the rate of said cycles to control the stroke and impact rate of the hammer, and means for down-crowding the carriage to hold the anvil continuously against the work piece to be driven by the hammer.

2. A mobile hydraulic driving machine for impacting a work piece comprising an automotive vehicle, a derrick assembly mounted on and supported by said vehicle, a driving tool removably mounted on the end of the derrick assembly, hydraulic means for rotating and tilting said driving tool relative to the derrick assembly, said driving tool including a stanchion, means loading said derrick assembly to press said stanchion against the ground a carriage slidably mounted on said stanchion, a hammer slidably carried by said carriage, hydraulic mechanism for raising and lowering the carriage on the stanchion, hydraulic mechanism for powering the hammer to impact against a work piece, a hydraulic mechanism for manipulating the derrick assembly to position the driving tool at a selected work site at any location relative to the vehicle, a speed sensitive valve controlling the stroke and rate of impact blows of the hammer, and a manual control for the speed of said valve.

3. A driving tool adapted to be mounted on a derrick rig which comprises a stanchion post attachable to said rig and adapted to rest on the ground, means controlling the attitude of the post relative to the ground, a carriage slidable on the post, a hammer guide mounted on said carriage, a spring-loaded anvil depending from the hammer guide, hydraulic means for down-crowding the carriage to compress the spring of the spring-loaded anvil, a hammer slidable in said guide for delivering hammer blows to said anvil, hydraulic mechanism lifting said hammer in said guide away from said anvil, tension springs stretched by said hydraulic mechanism for propelling the hammers against the anvil, a speed sensitive dump valve for the hydraulic mechanism to control the stroke and rate of delivery of impact blows of said hammer, and a manual control regulating speed of said dump valve.

4. A driving tool adapted to be detachably mounted on the end of a boom of a derrick rig which comprises a stanchion post adapted to rest on a work surface, means controlling the attitude of the post relative to the rig, means loading said derrick rig to press said stanchion post against the work surface, a carriage moveable along the length of the post, a ram guide on said carriage, a ram slidable in said guide, a hydraulic lift for said ram, means feeding hydraulic fluid to said lift, a rotary valve controlling flow of hydraulic fluid from said lift, a variable speed motor driving said rotary valve, and means actuated by an operator controlling the speed of said motor to cooperate with said means feeding the hydraulic fluid for regulating the stroke and rate of said ram.

5. The machine of claim 1 including hydraulic mechanism loading said lower and upper derrick boom to press the foot of the upright post against the ground.

6. The machine of claim 1 wherein the means for down-crowding the carriage is a hydraulic motor and a bleed valve for said motor controls the down-crowding load delivered by the motor.

7. The machine of claim 1 wherein the upright post is rotatably and tiltably mounted on the end of the upper derrick boom.

8. The machine of claim 7 wherein rotation of the post is controlled by a motor and tilting of the post is controlled by a hydraulic jack.

9. The machine of claim 2 wherein said hydraulic mechanism for powering said hammer compresses air on the hammer lifting stroke which is vented to the discharge side of the speed sensitive valve to cushion the discharge.

10. The machine of claim 2 wherein said stanchion is a hollow post rotatably supporting sprockets near the ends thereof and a chain trained over said sprockets raises and lowers said carriage and has one run through the interior of the post.

11. The mahcine of claim 2 wherein said driving tool has a cap bolted to the end of the derrick assembly and said cap carries means for rotating and tilting the driving tool relative to the derrick assembly.

12. The driving tool of claim 3 including a variable speed electric motor driving said dump valve.

13. The driving tool of claim 3 wherein the stanchion post is hollow and an extension foot is replaceably mounted on the lower end of the hollow post.

14. The driving tool of claim 3 including a work piece guide removably mounted on the lower end of the stanchion post for slidably guiding the work piece.

15. The driving tool of claim 14 wherein the anvil is hollow and receives the upper end of the work piece to cooperate with the guide for holding the work piece parallel with the post.

16. The driving tool of claim 4 wherein said means feeding hydraulic fluid to the hydraulic lift has a by-pass valve, the ram guide suspends a spring-loaded anvil and said by-pass valve is closed only when the spring of said anvil is compressed.

17. The tool of claim 4 wherein said hydraulic lift is a hydraulic jack receiving the hydraulic fluid beneath the piston thereof and compresses air above the piston on the lifting stroke to cushion discharge from said rotary valve.

18. The driving tool of claim 3 wherein the carriage has a sleeve embracing the hammer guide and a removable pin connection between the hammer guide and carriage prevents sliding of the guide in said sleeve.

19. The tool of claim 18 wherein said sleeve is composed of two bolted-together longitudinal halves adapted to be separated and wherein said pin is removable to permit removal of the hammer guide from the carriage.

20. A driving tool which comprises a derrick rig, a stanchion post mounted on said rig adapted to be positioned immediately adjacent the work site and rest on the surface of the work site, means on said rig pressing said stanchion post against the surface of the work site, a carriage slidable on said post, a hammer tool mounted on said carriage, a spring-loaded anvil suspended from said hammer tool and positioned to be struck by the hammer of said tool, means for down-crowding the hammer tool to compress the spring of said spring-loaded anvil causing the anvil to follow a work piece and minimizing recoil of the hammer tool.

* * * * *